US006270096B1

(12) United States Patent
Cook

(10) Patent No.: US 6,270,096 B1
(45) Date of Patent: Aug. 7, 2001

(54) STEERABLE IN-LINE SKATEBOARD

(76) Inventor: Bradley D. Cook, 2470 Tribble Creek Cove, Grayson, GA (US) 30017

( * ) Notice: Subject to any disclaimer, the term of this patent is extended or adjusted under 35 U.S.C. 154(b) by 0 days.

(21) Appl. No.: 09/495,968

(22) Filed: Feb. 2, 2000

(51) Int. Cl.[7] ..... B62B 1/00

(52) U.S. Cl. ..... 280/87.042; 280/11.223; 280/11.221; 280/87.041

(58) Field of Search ..... 280/87.01, 87.041, 280/87.042, 87.043, 14.21, 14.28, 11.22, 11.27, 11.28, 11.221, 11.223, 11.231

(56) References Cited

U.S. PATENT DOCUMENTS

| | | | | |
|---|---|---|---|---|
| 4,047,727 | | 9/1977 | Holladay et al. . | |
| 4,202,559 | | 5/1980 | Piazza, Jr. . | |
| 4,445,699 | * | 5/1984 | Darasko | 280/87.042 |
| 5,236,208 | | 8/1993 | Welsh . | |
| 5,330,214 | * | 7/1994 | Brooks et al. | 280/87.042 |
| 5,409,265 | * | 4/1995 | Douglass | 280/843 |
| 5,411,282 | | 5/1995 | Shannon . | |
| 5,419,570 | | 5/1995 | Bolletté . | |
| 5,513,865 | * | 5/1996 | Brooks et al. | 280/87.042 |
| 5,549,331 | * | 8/1996 | Yun et al. | 280/843 |
| 5,566,957 | * | 10/1996 | Ho | 280/11.22 |
| 5,660,401 | | 8/1997 | Yi . | |
| 5,707,068 | | 1/1998 | Bradfield . | |
| 5,803,473 | | 9/1998 | Bouden . | |
| 5,826,895 | | 10/1998 | Bradfield . | |
| 5,855,385 | * | 1/1999 | Hambsch | 280/87.042 |
| 5,951,027 | * | 9/1999 | Oyen et al. | 280/11.22 |
| 6,003,882 | * | 12/1999 | Colonese, Jr. et al. | 280/11.22 |
| 6,012,727 | * | 1/2000 | Chang | 280/11.28 |
| 6,029,984 | * | 2/2000 | Pivotto | 280/11.28 |

* cited by examiner

*Primary Examiner*—J. J. Swann
*Assistant Examiner*—L. Lum
(74) *Attorney, Agent, or Firm*—Hinkle & Associates, PC

(57) ABSTRACT

A skateboard comprising a rigid elongated board having front and rear portions, and front and rear wheel trucks mounted to the underside of the board. The wheel trucks each have multiple wheels mounted in-line. A steering platform is at the front of the board for use by the rider to steer the board. The steering platform is rotatable and is connected by a linkage system to the wheel trucks wherein, by rotating the steering platform, each wheel within their respective truck is equally angularly displaced to effect a turning movement of the board.

12 Claims, 4 Drawing Sheets

STEERABLE IN-LINE SKATEBOARD

BACKGROUND OF THE INVENTION

1. Field of the Invention

The present invention relates generally to the field of skateboards, and more particularly to an improved skateboard which comprises two or more sets of in-line wheel trucks wherein two or more wheel trucks may be steered by the foot of the rider regardless of any shifts in the weight of the rider.

2. Description of the Related Art

The prior art is replete with patents dealing with skateboards. Typically, skateboards come with wheel trucks having axial alignment for multiple wheels on the trucks or may have in-line wheel trucks similar to the type used in the present invention. The typical conventional skateboard comprises a rigid elongated board having front and rear portions with a wheel truck assembly fixedly mounted below the front portion of the board and a rear wheel truck assembly fixedly mounted beneath the rear portion of the board. Normally, steering is accomplished by a complex redistribution of the weight of the rider standing on the board. Obviously, learning to redistribute the weight as required to steer a skateboard in a safe manner is a time consuming and dangerous process.

Some of the prior art disclose skateboards which have axially aligned wheels and, to assist the rider in steering the board, the wheels are tapered from side to side to effectively increase the turning ability of the board when the board is tilted to one side or the other to effect a sharper turning radius. However, such boards do not have the capability of individually steered wheel trucks, thereby limiting the amount of steerability of the board.

Other patents in the prior art are known to have steerable wheel trucks. For instance, in the patent to Piazza, Jr. (U.S. Pat. No. 4,202,559) a steerable skateboard is shown wherein a steering platform is placed at the front of the board for effecting steering by the user, but only the front trucks is steerable. There is no linkage to the rear truck. The board of the Piazza patent utilizes aligned wheel trucks and obviously only the front wheel truck is steerable.

In the Welsh Patent (U.S. Pat. No. 5,236,208) another type of skateboard is shown wherein the board may be steerable both from the front and the rear, and the user will have steering capability by using both feet. Again, there is no linkage between the front and rear trucks and the effective steering must be by both feet. This patent also discloses wheel trucks which have axially aligned wheels and not in-line wheel trucks.

In the Yi Patent (U.S. Pat. No. 5,660,401) an in-line skateboard is shown having turning capability. However, the rollers are only pivotally mounted for steerability and the steering is effected in response to pressure placed upon the wheel trucks by the user. There is no independent steering of the wheel trucks from the foot of the user.

SUMMARY OF THE INVENTION

In accordance with the present invention and the contemplated problems which have and continue to exist in this field, the objectives of this invention are to provide a new and improved steerable in-line skateboard. The board has, at its front, a circular steering platform onto which one foot of the user is placed and then, by turning the platform with the foot, the person steering is able to effect angular displacement of all of the wheels of both the front wheel truck and the rear wheel truck to effect a rapid and decisive turning maneuver. When the platform is rotated and the front wheels of the front truck are turned, a steerage linkage mechanism cooperatively is attached to the wheels of the rear truck and will also effect an angular displacement of the rear wheels to greatly enhance the turning of the board.

Each wheel of each truck is individually mounted upon an axle wherein each axle is angularly displaced upon the rotation of the platform by the rider. To effect a rapid turning motion, the wheels of the rear truck are angularly displaced in a direction opposite from the angular displacement direction of the wheels of the front truck.

Further, since each wheel axle is angularly displaceable, a system is incorporated to the "at-rest" position of the axles and to provide to the skateboard a datum position which will provide a straight travel path unless the rider rotates the platform to effect the turning maneuver.

Other objects, advantages and capabilities of the invention will become apparent from the following description taken in conjunction with the accompanying drawings showing the preferred embodiment of the invention.

DESCRIPTION OF THE PREFERRED EMBODIMENTS

Figure 1:
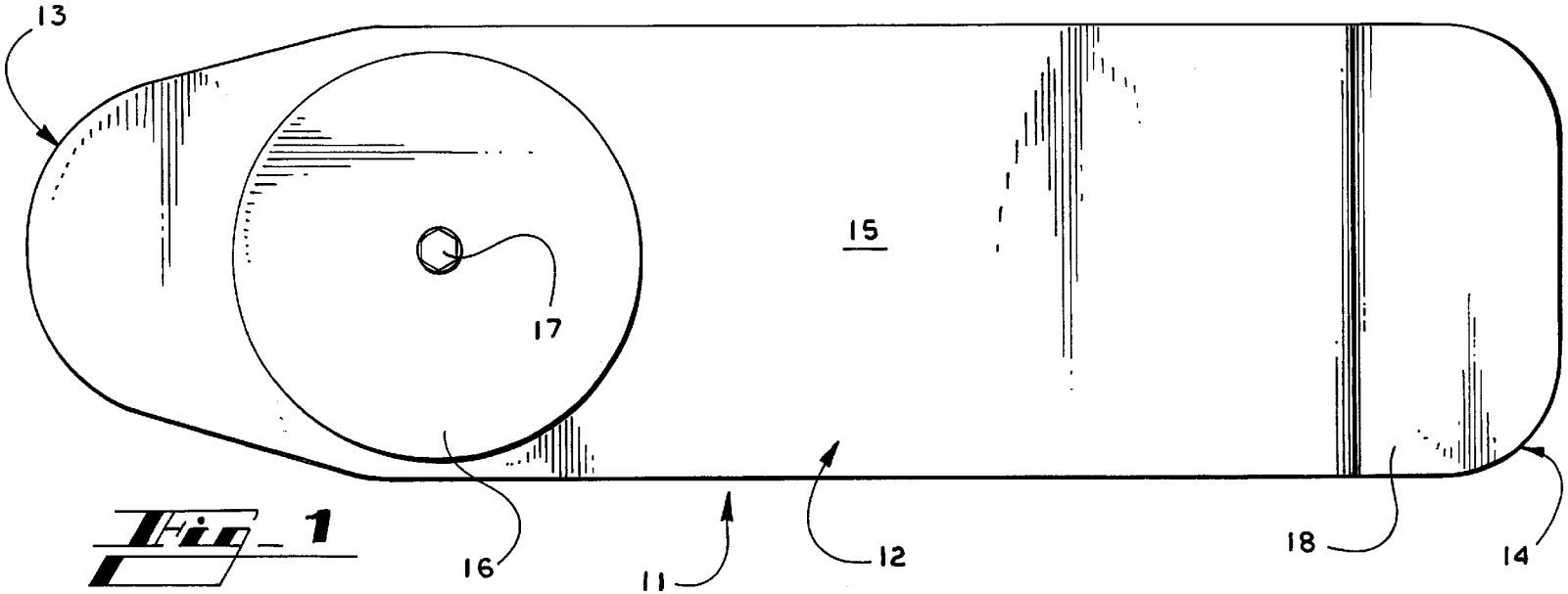
FIG. 1 is a top plan view of the skateboard of the present invention.
Figure 2:
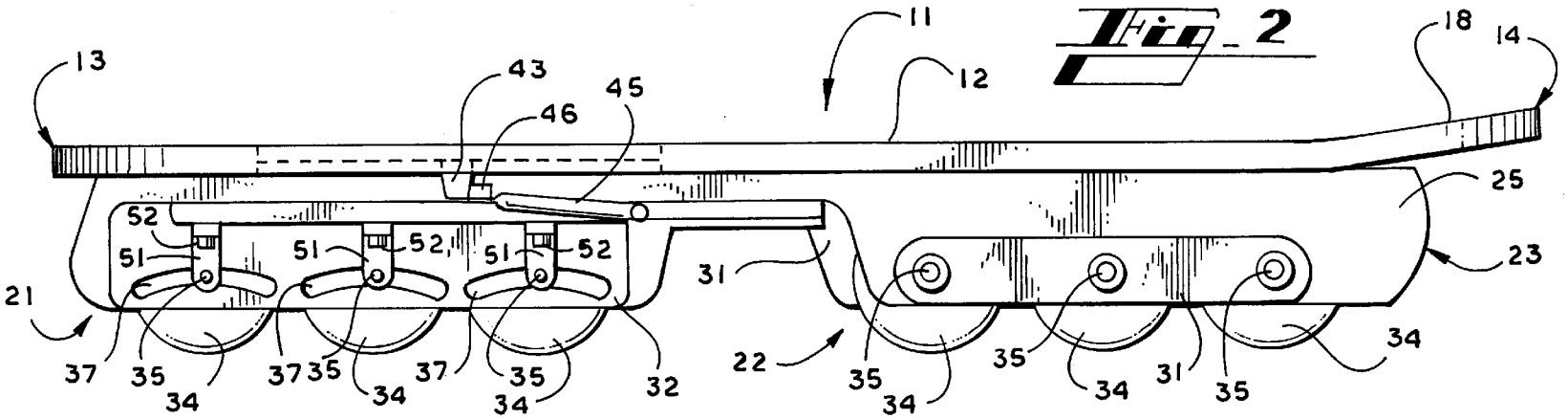
FIG. 2 is a left side elevation view.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIGS. 1 and 2. The skateboard 11 comprises a rigid elongated board member 12 having a tapered front portion 13 and a rounded blunt rear portion 14. Near the tapered front portion 13, lying within the top of the board 15 is a circular steering platform 16 which is mounted by steering pivot 17 in order for is the platform 16 to be rotatably movable by a selected foot of a rider of the board. While in the preferred embodiment, the steering platform 16 is shown at the front portion of the board 15, it may be that some riders may prefer it to be mounted at the rear and such a configuration is contemplated herein. To give the rider a sense of feel as to the position of the rear portion 14 of the board, it is contemplated that the rear portion will be upwardly flared in an area shown by numeral 18 which will allow the user a definite sense of feel of where the end of the board is at any one time.

Upon the flat bottom board surface 19 are mounted a front wheel truck 21 and rear wheel truck 22. The wheel trucks are mounted within a generally U-shaped frame 23 which is a suitably fixedly attached to the bottom surface 19 of the board 12. The frame 23 has a middle portion 24, which is attached to the bottom surface 19, and depending downwardly from each edge of the middle portion of the frame 24 are depending frame flanges 25 and 26 respectively. The frame 23 is generally constructed so that a proximal end 27 lies near the front portion 13 of the board and a distal portion of the frame 28 lies near the rear portion 14 of the board.

Placed near the proximal end 27 of the frame 23, and mounted to the frame flange 26, is a bearing support plate 29 having an elongated configuration so constructed that it will house the bearing structure of the individual wheels. A similar bearing support plate 31 is mounted to depending frame flange 25 near the distal end 28 of the frame.

Mounted to depending frame flange 25 near the proximal end of the frame 27 is an elongated front truck axle plate 32 which also is designed to cooperate with the axle assembly of the individual wheels of the front truck 21. Similarly, at the distal end 28 of the frame, in conjunction with the wheels of the rear truck 22, is a rear truck axle plate 33 which is mounted to depending frame flange 26.

Turning now to the individual wheel trucks 21 and 22, it can be seen that each truck has three wheels 34. While the contemplated embodiment utilizes three wheels in each truck, it should be noted that this would be a matter of design and possibly economy. However, each truck could have more or less wheels as desired and such is contemplated within this invention. As has been previously noted, the wheels 34 of each truck are mounted in-line as shown. Each wheel 34 is mounted upon an axle 35 and each axle is mounted within the frame 23. With respect to front truck 21, the axles 35 have one end fixedly mounted within a spherical ball bearing 36 which is, in turn, mounted within the bearing support plate 29. The other end of each wheel axle 35 in the front truck is then mounted within an arcuate axle slot 37 within the front truck axle plate 32. The steerage end 38 of each axle 35, being mounted within the arcuate axle slot 37, is capable of a complete range of motion fore and aft within the axle slot upon application of a moving force to the steerage end 38 of the axle. When the wheels 34 of each wheel truck are in complete longitudinal alignment for straight movement of the skateboard 11, each axle will be resting at the top center position 39 of the arcuate axle slot. The rear truck 22 has a similar arrangement, however, the positions of the parts are reversed with respect to the depending frame flanges. In the rear truck 22, the axle 35 terminates in the spherical ball bearing 36 which is mounted in the bearing support plate 31. The steerage end 38 of the axle 35 is positioned within the arcuate axle slot 37 of the axle plate 33. These differences of location within the depending frame flanges will become apparent from the later description of the operation of the invention.

Figure 3:
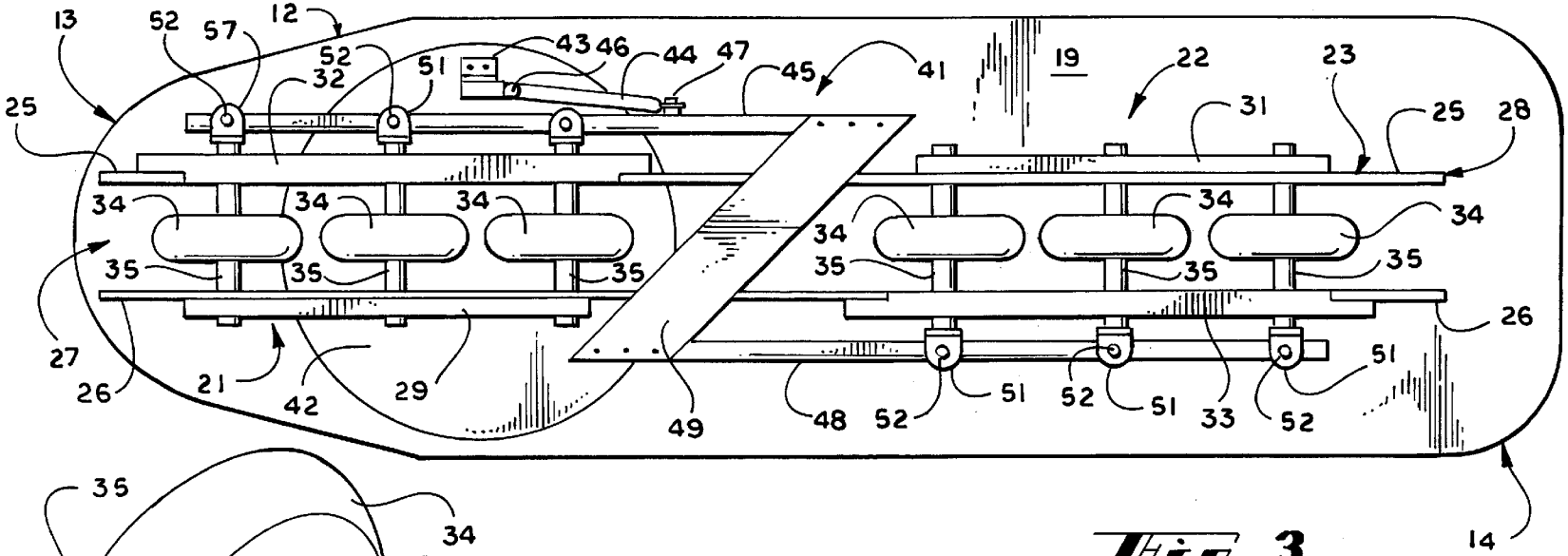
FIG. 3 is a bottom plan view.
Figure 4:
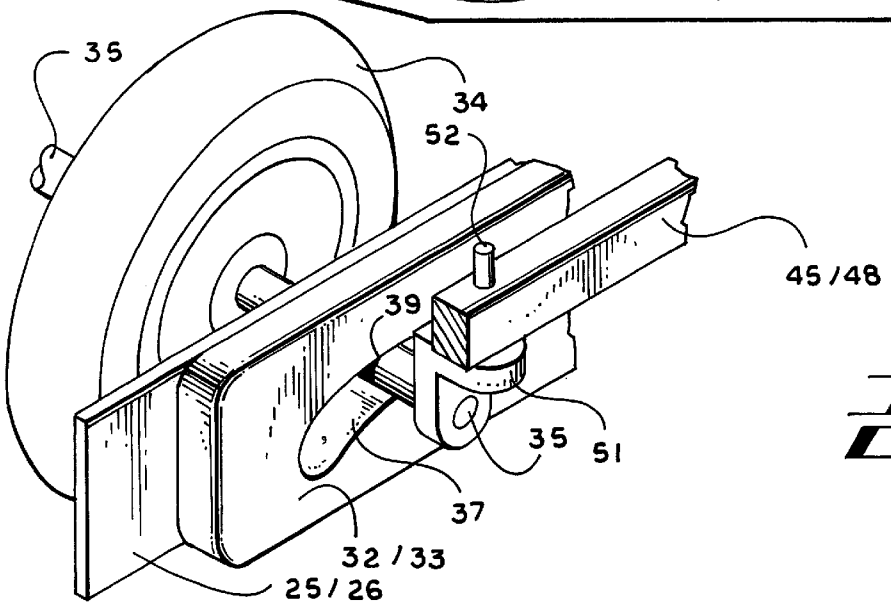
FIG. 4 is a partial perspective view of a wheel assembly mounted in the arcuate axle slot with details of the linkage attaching to the wheel assembly.

In order to effectively steer wheel trucks 21 and 22, a steering mechanism 41 is shown in FIG. 3. The input to the steering mechanism is from the steering platform 16 which has a crank mount 43 fastened to the underside 42 of the platform to which is attached a steering linkage 44. The steering linkage connects the crank mount 43 with a front truck wheel linkage arm 45 by fastening the steering linkage 44 with a pivot 46 to the crank mount 43 at the proximal end of the linkage 44, and at the distal end of the linkage 44 by a fastener 47. The front truck wheel linkage arm 45 is in turn connected to the rear truck wheel linkage arm 48 by a linkage plate 49 which connects the distal end of the linkage arm 45 to the proximal end of linkage arm 48.

The front truck wheel linkage arm 45 is in turn connected to each axle support member 51 by linkage pin 52. With the linkage just described, it is evident that all wheels of the front truck 21 and all wheels of the rear truck 22 will turn in tandem by the same degree of angularity when the platform 16 is rotated. As platform 16 is rotated, the crank mount 43 is moved forwardly or rearwardly, as the case may be, thereby moving the steerage linkage 44 in the same direction which will move the linkage arm 45 and the truck linkage plate 49, and ultimately will move the rear truck wheel linkage arm 48. These movements will effect an angular displacement of the wheels of the respective trucks in a manner shown in FIG. 5.

Figure 5:
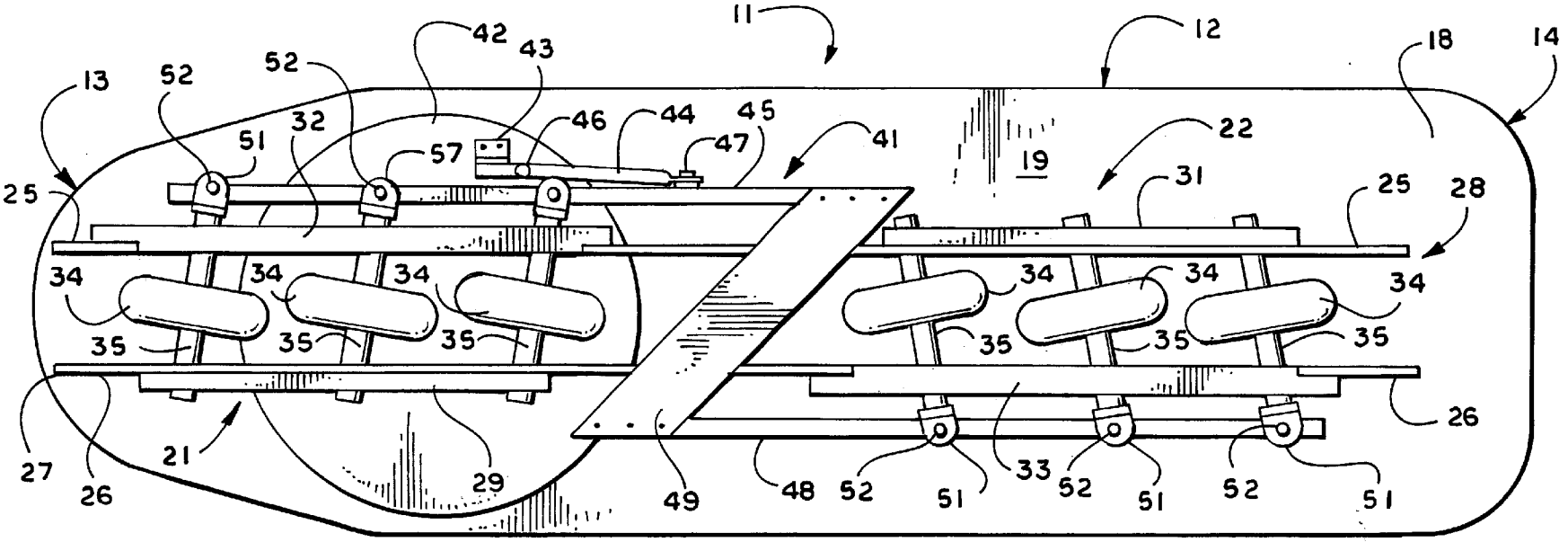
FIG. 5 is a bottom plan view showing the wheels effecting a turning maneuver.
Figure 6:
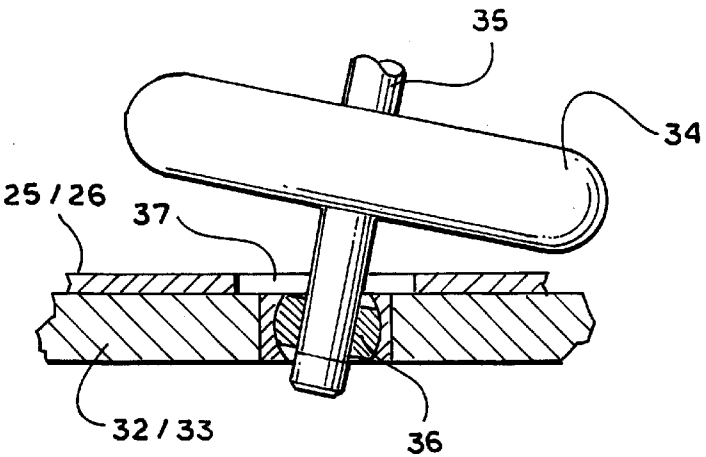
FIG. 6 is a partial bottom plan sectional view of a portion of the bearing of the wheel assembly.

Referring now to FIG. 5, it can be seen that if the platform 16 is rotated clockwise (when viewing the underside of the skateboard 11) the entire steering mechanism 41 is moved toward the rear portion 14 of the skateboard and this effectively angularly displaces wheels 34 of the front truck 21 by moving the respective axles 35 in a manner which will turn the wheels in the direction indicated in FIG. 5. Concurrently therewith, the rear truck axle plate 33 will move the axles 35 of the wheels 34 of the rear truck 22 in the manner shown. By such a movement, the skateboard will make an effective sharp turn in the direction indicated by the angular displacement of the wheels of the front truck 21.

Figure 7:
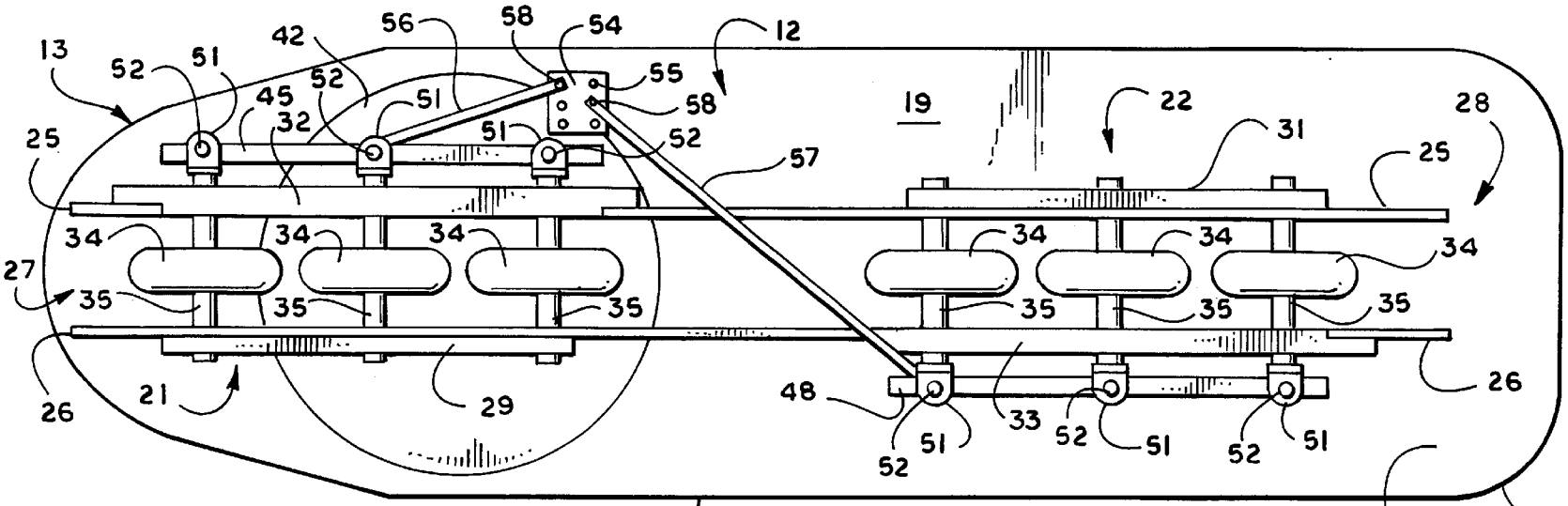
FIG. 7 is a bottom plan view of a second embodiment of the steering linkage of the present invention.
Figure 8:
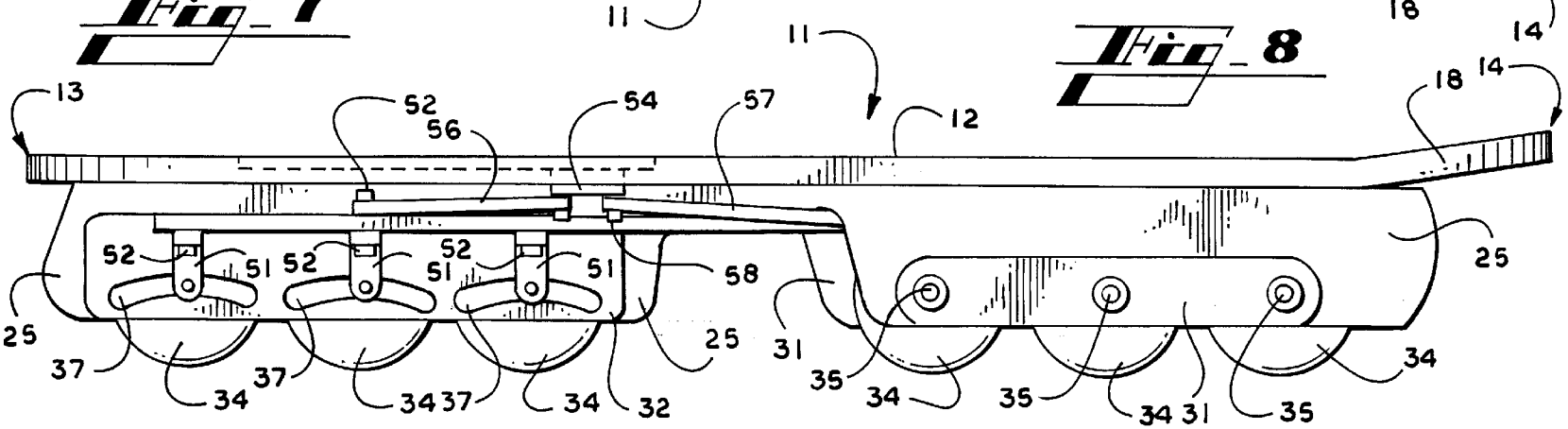
FIG. 8 is a side elevation vie of the embodiment of FIG. 7.

FIGS. 7 and 8 show a modification of the steering mechanism 41 as disclosed in FIG. 3. The modified steering mechanism is indicated by the numeral 53. The steering mechanism of FIGS. 7 and 8 allow the rider to adjust the effective turning rate of the front and rear wheel trucks 21 and 22 respectively. The modified steering mechanism comprises a crank mount 54 mounted to the underside 42 of the platform 16. The crank mount is of generally rectangular configuration and would be supplied with a plurality of apertures 55 to which a forward steering linkage 56 and a rear steering linkage 57 would be suitably attached by fasteners 58 at the proximal ends of the respective steering linkages. The distal ends of the respective steering linkages would be suitably connected by linkage pins 52 and fixed for rotatable motion adjacent to the respective truck wheel linkage arms 45 and 48. The invention of the modified version would operate essentially the same as the originally disclosed version in that the turning of steering platform 16 would move the crank mount forwardly or rearwardly thereby allowing the steering linkages 56 and 57 to operate upon the wheel linkage arms 45 and 48 to angularly displace the wheels of the respective front and rear trucks 21 and 22 in a manner shown in FIG. 5. While the operation of the steering mechanism in the embodiments of FIGS. 7 and 8 work very similarly to that in the earlier figures, the addition of adjustable steering linkages 56 and 57 allow the user to adjust the turning rate of the wheels of the individual trucks for a more precise steering ratio in accordance with the desires of the rider.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A skateboard comprising:

a rigid elongated board with a longitudinal center line running fore and aft and front, the board having front and rear portions, and having a top surface and a bottom surface, a U-shaped frame mounted to the bottom surface of the board, the U-shaped frame having a first depending flange and a second depending flange;

at least one wheel truck mounted to the U-shaped frame;

a steering platform having a top surface and a bottom surface, the steering platform mounted within the top surface of the board for rotatable movement;

the wheel truck has at least one wheel rotatably mounted upon an axle disposed transversely to the longitudinal centerline of the board, a first end of the axle being mounted in a bearing in the first depending flange of the U-shaped frame and a second end of the axle being mounted for fore and aft movement in a slot in the second depending flange of the U-shaped frame; and a steering mechanism connecting the steering platform to the wheel truck.

2. A skateboard as claimed in claim 1, wherein the wheel truck is mounted between the first and second depending flanges of the U-shaped frame adjacent to the board front portion and a second wheel truck is mounted between the first and second depending flanges of the U-shaped frame adjacent to the rear portion.

3. A skateboard as claimed in claim 2, wherein the second wheel truck has at least one wheel rotatably mounted upon an axle disposed transversely to the longitudinal centerline of the board, a first end of the axle being mounted in a bearing on the second depending flange of the U-shaped frame and a second end of the axle being mounted for fore and aft movement in a slot in the first depending flange of the U-shaped frame.

4. A skateboard as claimed in claim 1, wherein the steering platform is mounted in the board adjacent to the front portion.

5. A skateboard as claimed in claim 1, wherein the wheel truck has a plurality of wheels.

6. A skateboard as claimed in claim 5, wherein each wheel truck has a plurality of in-line wheels.

7. A skateboard as claimed in claim 1, wherein the slot has an arcuate shape.

8. A skateboard as claimed in claim 1, wherein the steering mechanism comprises a steering linkage connecting the steering platform to a first wheel linkage arm and to a second wheel linkage arm, the first linkage arm being connected to the second end of each axle of the first wheel truck and the second wheel linkage arm being connected to the second end of each axle of the second wheel truck.

9. A skateboard as claimed in claim 8, wherein the first wheel linkage arm is positioned adjacent to the second depending flange of the U-shaped frame and the second wheel linkage arm is positioned adjacent to the first depending flange of the U-shaped frame, a linkage plate interconnecting the linkage arms.

10. A skateboard as claimed in claim 9, wherein each wheel truck has a plurality of in-line wheels.

11. A skateboard as claimed in claim 10, wherein the steering platform is mounted in the board adjacent to the front portion.

12. A skateboard comprising:

a rigid elongated board with a longitudinal center line running fore and aft and front, the board having rear portions, and having a top surface and a bottom surface, a U-shaped frame mounted to the bottom surface of the board, the U-shaped frame having a first depending flange and a second depending flange;

multiple wheel trucks mounted to the U-shaped frame;

a first wheel truck is mounted to the U-shaped frame adjacent to the board front portion and a second wheel truck is mounted to the U-shaped frame adjacent to the board rear portion;

a steering platform having a top surface and a bottom surface, the steering platform mounted within the top surface of the board for rotatable movement;

the steering platform being mounted in the board adjacent to the front portion;

the wheel trucks each having a plurality of in-line wheels wherein each wheel is rotatably mounted upon an axle disposed transversely to the longitudinal centerline of the board, a first end of each axle of the first wheel truck being mounted in a bearing in the first flange of the U-shaped frame and a second end of each axle of the first wheel truck being mounted for movement in an arcuate slot in the second flange of the U-shaped frame, a first end of each axle of the second wheel truck being mounted in a bearing on the second flange of the U-shaped frame and a second end of each axle of the second wheel truck being mounted for movement in an arcuate slot in the first flange of the U-shaped frame;

a steering mechanism connecting the steering platform to each of the wheel trucks; and the steering mechanism comprising a steering linkage connecting the steering platform to a first wheel linkage arm and to a second wheel linkage arm, the first linkage arm being connected to the second end of each axle of the first wheel truck and the second wheel linkage arm being connected to the second end of each axle of the second wheel truck, the first wheel linkage arm being positioned adjacent to the second depending flange of the U-shaped frame and the second wheel linkage arm being positioned adjacent to the first depending flange of the U-shaped frame, a linkage plate interconnecting the linkage arms.

* * * * *